US005522515A

United States Patent [19]

Pech et al.

[11] Patent Number: 5,522,515

[45] Date of Patent: Jun. 4, 1996

[54] RING SEGMENT CONNECTION

[75] Inventors: David J. Pech; Wayne W. Beebe; Terry W. Kleppe, all of Manitowoc, Wis.

[73] Assignee: The Manitowoc Company, Inc., Manitowoc, Wis.

[21] Appl. No.: 424,553

[22] Filed: Apr. 17, 1995

Related U.S. Application Data

[63] Continuation of Ser. No. 1,826, Jan. 8, 1993, abandoned.

[51] Int. Cl.[6] ..... B66C 23/26

[52] U.S. Cl. ..... 212/175; 212/253; 238/231; 384/593

[58] Field of Search ..... 212/175, 253, 212/180, 179, 181; 403/13, 14, 364; 74/448; 384/591, 592, 593; 238/231, 232

[56] References Cited

U.S. PATENT DOCUMENTS

| | | | |
|---|---|---|---|
| 1,038,156 | 9/1912 | Kurzawskey | 238/232 |
| 1,042,702 | 10/1912 | Maddox | 238/231 |
| 1,079,825 | 11/1913 | Bamber | 238/231 |
| 1,148,841 | 8/1915 | Hubbell | 238/231 |
| 2,291,014 | 7/1942 | Woody | 403/13 |
| 3,878,944 | 4/1975 | Beduhn et al. . | |
| 3,955,684 | 5/1976 | Novotny . | |
| 4,266,679 | 5/1981 | Juergens . | |
| 4,315,386 | 2/1982 | Clarke . | |
| 4,316,548 | 2/1982 | Helm et al. . | |
| 4,336,889 | 6/1982 | McGrew . | |
| 4,387,813 | 6/1983 | Beduhn et al. . | |
| 4,387,814 | 6/1983 | Beduhn et al. . | |
| 4,394,911 | 7/1983 | Wittman et al. . | |
| 4,483,448 | 11/1984 | Wittman et al. . | |
| 4,579,234 | 4/1986 | Delago et al. . | |
| 4,601,402 | 7/1986 | Helm et al. . | |
| 4,622,860 | 11/1986 | Cametti et al. . | |
| 4,625,820 | 12/1986 | Christian . | |
| 5,082,128 | 1/1992 | Franzen et al. . | |
| 5,176,267 | 1/1993 | Pech . | |
| 5,347,880 | 9/1994 | Kallenberger | 74/448 |

FOREIGN PATENT DOCUMENTS

| | | | |
|---|---|---|---|
| 533502A1 | 3/1993 | European Pat. Off. . | |
| 1336224 | 7/1963 | France . | |
| 2238824 | 2/1975 | France . | |
| 408776 | 1/1925 | Germany | 74/448 |

OTHER PUBLICATIONS

Manitowoc Engineering Co. complete line brochure (1990).

Mannesmann Demag brochure for Ringlift Cranes (date unknown).

Mannesmann Demag brochure for its Ringlift System (date unknown).

*Primary Examiner*—David A. Bucci

*Assistant Examiner*—Thomas J. Brahan

*Attorney, Agent, or Firm*—Willian Brinks Hofer Gilson & Lione; Steven P. Shurtz

[57] ABSTRACT

A ring for supporting a lift crane includes at least two ring segments each having two ends, the ends of the ring segments comprising at least one horizontal plate and at least one vertical plate. The horizontal plates and the vertical plates of adjacent ends of the ring segments are disconnectably secured to one another to form the ring support. In a preferred embodiment, the horizontal plates are connected by a vertical pin and the vertical plates are connected by a horizontal pin.

21 Claims, 6 Drawing Sheets

FIG. 8
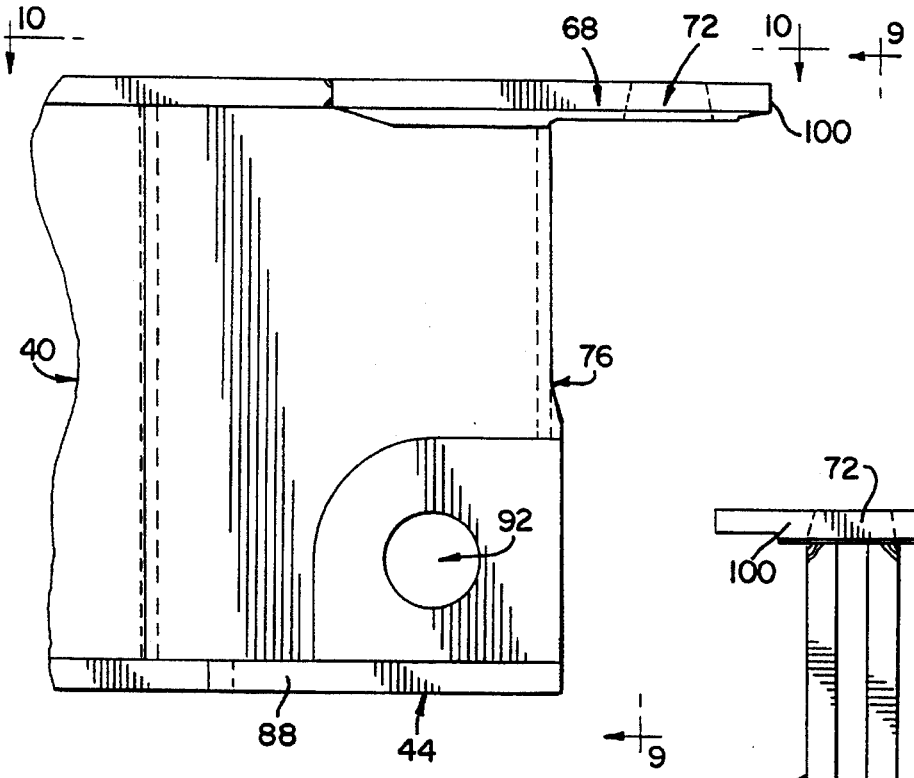
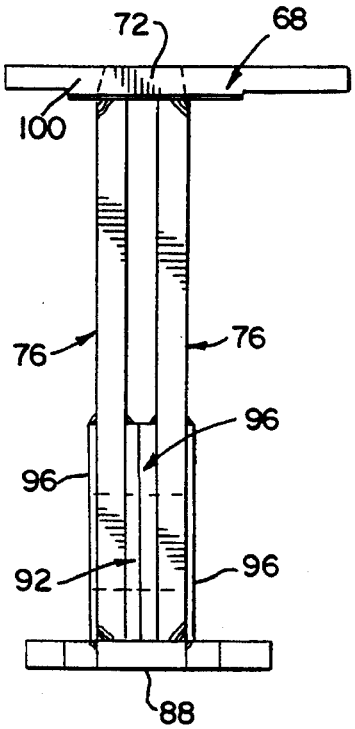
FIG. 9
FIG. 10
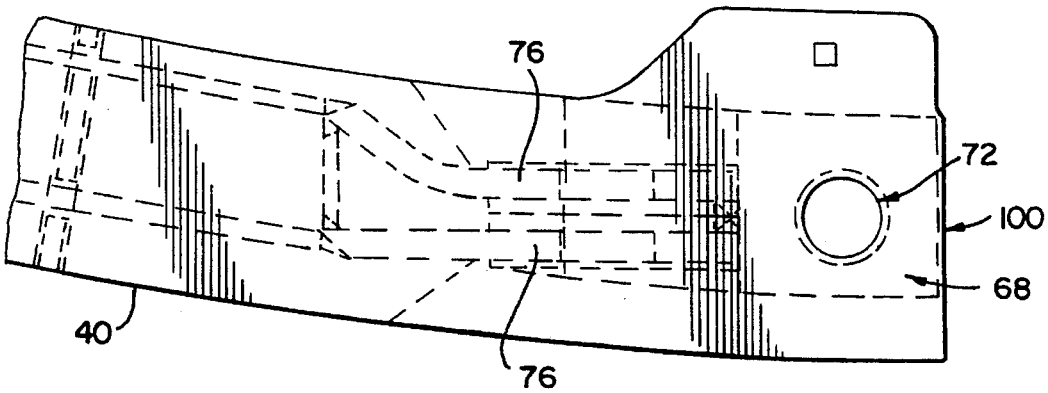

RING SEGMENT CONNECTION

This application is a continuation of application Ser. No. 08/001,826, filed Jan. 8, 1993, abandoned

BACKGROUND OF THE INVENTION

This invention relates generally to the field of ring support structures for lift cranes and, more particularly, to improved connections between the ring segments which form the ring support structures.

The load lifting capabilities of cranes have been increased by the development and use of crane support rings. By distributing the weight of a crane and its load over a large surface area, the support ring stabilizes the crane and increases the lift capacity thereof. The support ring is usually supported above the ground by timber blocks wedged between the support ring and the ground or by jacks intervally positioned along the perimeter of the ring.

Since crane support rings are typically large (60 ft. diameter rings are common), the tings must often be disassembled for transport to other jobsites, positioning of liftcranes, storage, etc. Therefore, support rings typically are comprised of a number of ring segments which are connected together to form the support ring. Because the ring segments are frequently connected and disconnected, a ring segment connection allowing rapid and simple assembly of the ring segments is desirable.

As is well known in the art, ring segments are usually connected by means of bolt connectors. For example, U.S. Pat. No. 4,579,234 to Delago et al. discloses that the horizontal, overlapping flanges of adjacent ends of two ring segments may be bolted together. Typically, to insure the structural integrity of the support ring, many bolts, e.g., 6, 8 or 10, are used to interconnect the ring segments. While the use of bolt connectors provides satisfactory results, removing the large number of bolts to disconnect the ring segments, and then performing the opposite task to assemble the ring, is time-consuming and inefficient.

SUMMARY OF THE INVENTION

According to a first aspect of the present invention, there is provided a ring for supporting a lift crane including at least two ring segments each having two ends, the ends of each ring segment comprising a horizontal plate and at least one vertical plate, the horizontal plates and the vertical plates of adjacent ends of the ring segments being disconnectably secured to one another to form the ring.

According to a second aspect of the present invention, there is provided a ring for supporting a lift crane including: at least one first ring segment having two ends, each end comprising a first horizontal plate having a hole therein, and at least one first vertical plate attached to the first horizontal plate and having a hole therein; at least one second ring segment having two ends, each end comprising a second horizontal plate having a hole therein and positioned to overlie the first horizontal plate of an adjacent end of the at least one first ring segment, and at least one second vertical plate attached to the second horizontal plate and having a hole therein, the at least one second vertical plate positioned to abut the first vertical plate of an adjacent end of the at least one first ring segment; and a plurality of pins for connecting the horizontal and vertical plates of adjacent ends of the at least one first and second ring segments to form the ring.

According to a third aspect of the present invention, there is provided a ring segment connection including a first connector comprising a first horizontal plate and at least one first vertical plate connected to the first horizontal plate, a second connector comprising a second horizontal plate configured to overlie the first horizontal plate and at least one second vertical plate configured to abut the at least one first vertical plate, and a connector for connecting the first and second horizontal plates and the at least one first and second vertical plates.

The ring segment connection of the present invention has the advantage of allowing ring segments to be easily and rapidly connected to form a support ring. Additionally, the present invention provides a ring segment connection which has a limited number of connectors for connecting adjacent ring segments. Furthermore, the ring segment connection of the present invention has improved force carrying capabilities.

Further advantages of the present invention will become apparent during the following description, taken in conjunction with the accompanying drawings.

BRIEF DESCRIPTION OF THE DRAWINGS

FIG. 8 is an elevational view taken along line 8—8 of FIG. 4;

FIG. 9 is an end view taken along line 9—9 of FIG. 8;

FIG. 10 is a plan view taken along line 10—10 of FIG. 8;

DETAILED DESCRIPTION OF THE PRESENTLY PREFERRED EMBODIMENT

The preferred embodiment of the present invention relates to a ring segment connection for a crawler-mounted crane, other aspects of which are disclosed in the following copending applications assigned to the assignee of the present application:

"Control and Hydraulic System for a Liftcrane", and issued Feb. 23, 1993 as U.S. Pat. No. 5,189,605;

"Quick Disconnect System for Construction Equipment with Rotatable Upper Works", issued Jan. 5, 1993 as U.S. Pat. No. 5,176,267

"Control and Hydraulic System for Liftcrane", issued Mar. 22,1994 as U.S. Pat. No. 5,297,019;

"Quick-Connect Sectional Boom Members for Cranes and the Like", issued Apr. 6, 1993 as U.S. Pat. No. 5,119, 586;

"Carbody to Crawler Connection", filed Sep. 20, 1991 and assigned Ser. No. 07/762,764;

"Crane Upper Works to Lower Works Alignment System", issued on Jun. 27, 1995 as U.S. Pat. No. 5,427,256;

"Easily Removable Sheave Assembly", filed Sep. 20, 1992 and assigned Ser. No. 07/762,766;

"Self-Assembling and Self-Disassembling Crawler Crane", filed Sep. 20, 1991 and assigned Ser. No. 07/762,767; and "Longitudinally Divisible Crane Boom Segment", issued on Apr. 18, 1995 as U.S. Pat. No. 5,406,767. Each of the above-listed applications is hereby incorporated by reference.

Figure 1:
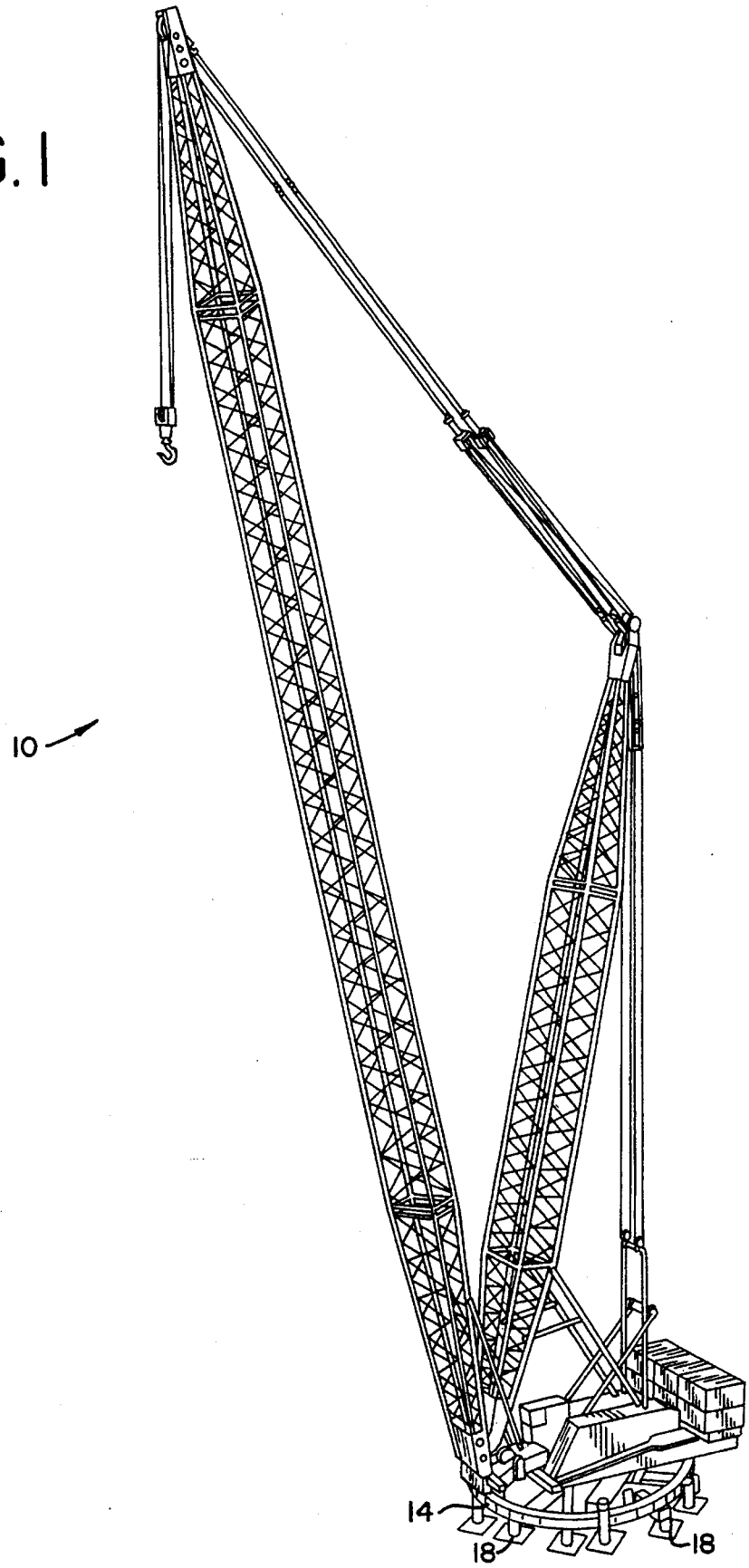
FIG. 1 is a perspective view of a lift crane supported on a ring support structure of the present invention.

Turning now to the drawings, there is shown in FIG. 1 a lift crane 10 supported by a ring support structure 14. The ring support structure 14 is supported above the ground by jacks 18 intervally located along its perimeter. The jacks 18 also function to transfer the weight of the crane 10 and its load to the ground. While the use of jacks 18 to support the ting support structure 14 is preferred, timber blocks (not shown) may also be wedged between the ring support structure 14 and the ground to support the ring 14.

Figure 2:
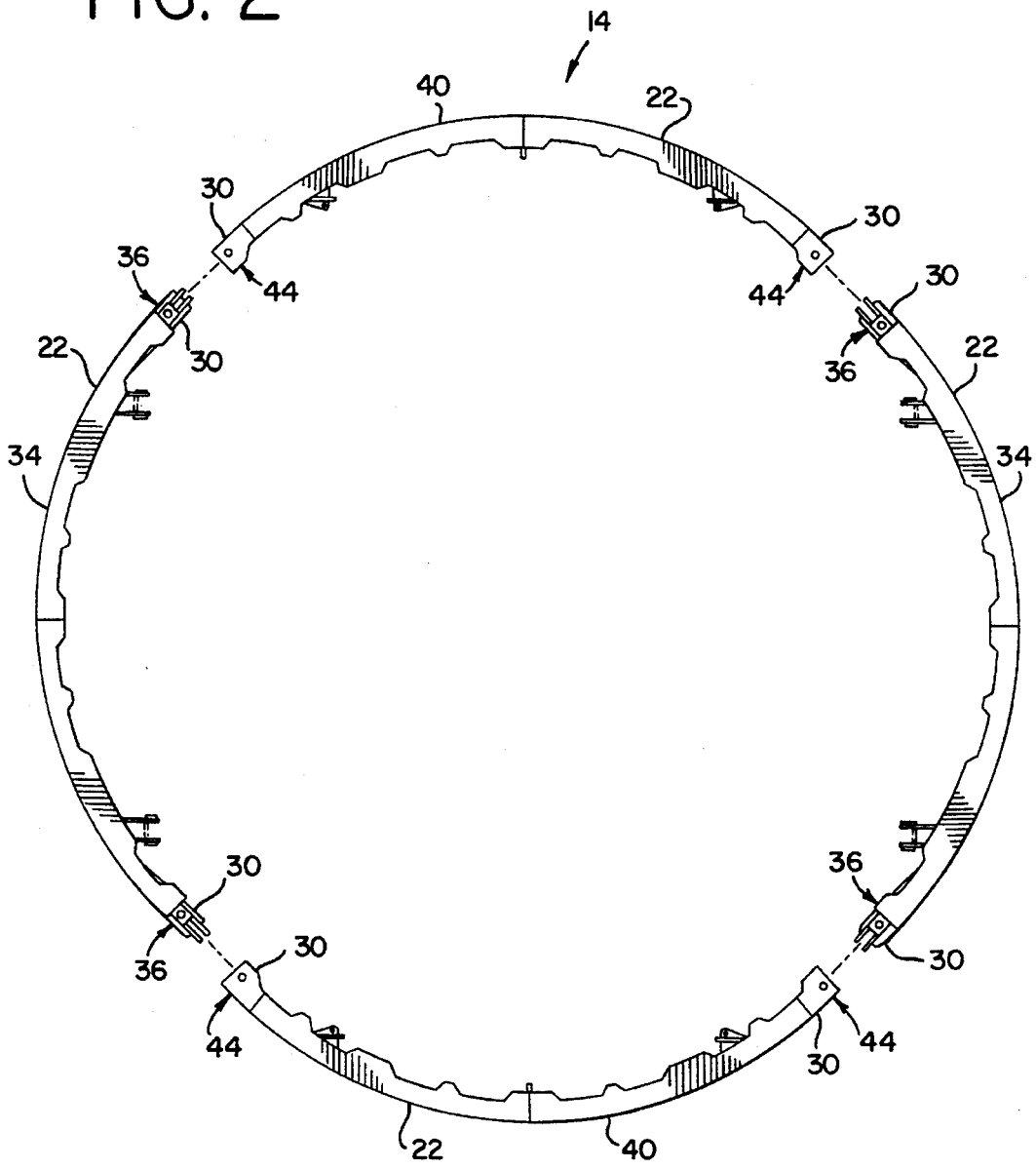
FIG. 2 is an exploded plan view of the ring support structure of FIG. 1, comprised of four ring segments.

An exploded plan view of the ring support structure 14 is shown in FIG. 2. Preferably, as shown in FIG. 2, the ring 14 is constructed of four ring segments 22 of identical arc lengths. Alternately, however, the ting 14 may be constructed of two, six, eight or any other suitable number of ring segments 22, and the ring segments 22 may have differing arc lengths.

Figure 3:
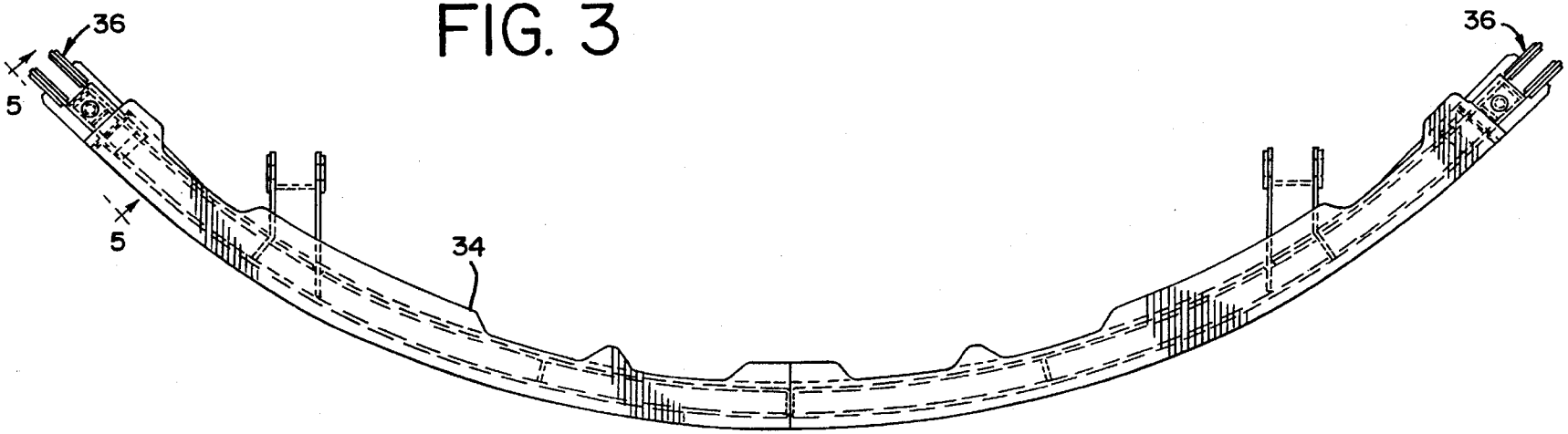
FIG. 3 is a plan view of one of the ring segments shown in FIG. 2.
Figure 4:
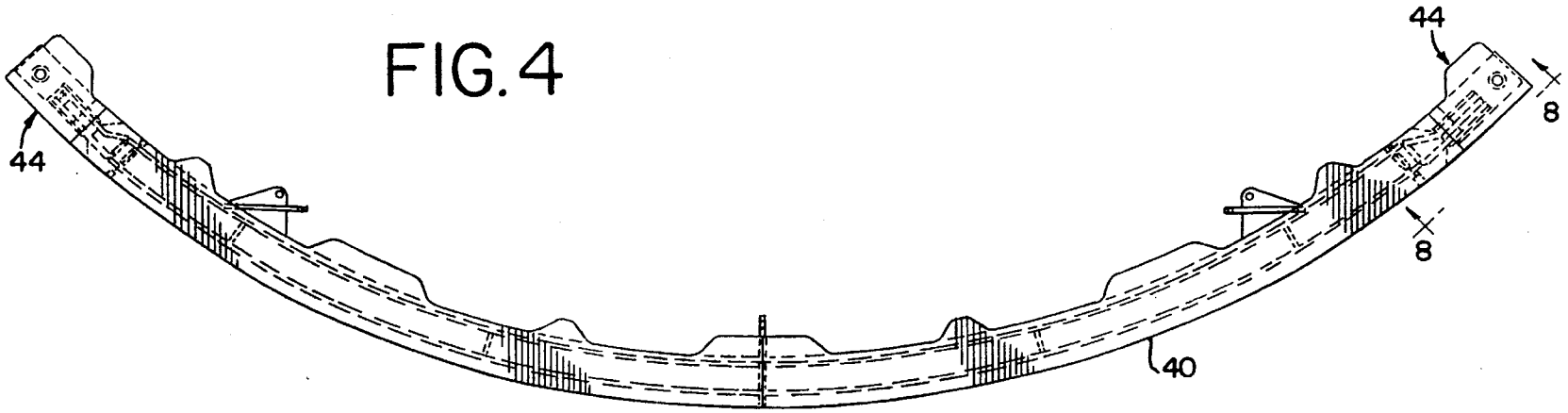
FIG. 4 is a plan view of another of the ring segments shown in FIG. 2.

As shown in FIG. 2, each ring segment 22 has two ends. Each end includes a connector 30 which connects to a connector 30 on an adjacent end of another ring segment 22. As will be described herein, for ease of assembly it is preferred that both ends of the same ting segment 22 have identical connectors 30. Therefore, in the preferred embodiment shown in FIG. 2, it can be deduced that two ring segments 34 will have ends having a first type of connector 36 and that the other two ring segments 40 will have ends having a second type of connector 44 which is connectable to the first type of connector 36. Enlarged plan views of the two types of ring segments 34, 40 are shown in FIGS. 3 and 4.

For ease of discussion, the ting segments identified by numeral 34 in FIG. 2 will be referred to as the first ting segments and the ring segments identified by numeral 40 will be referred to as the second ring segments.

Figure 5:
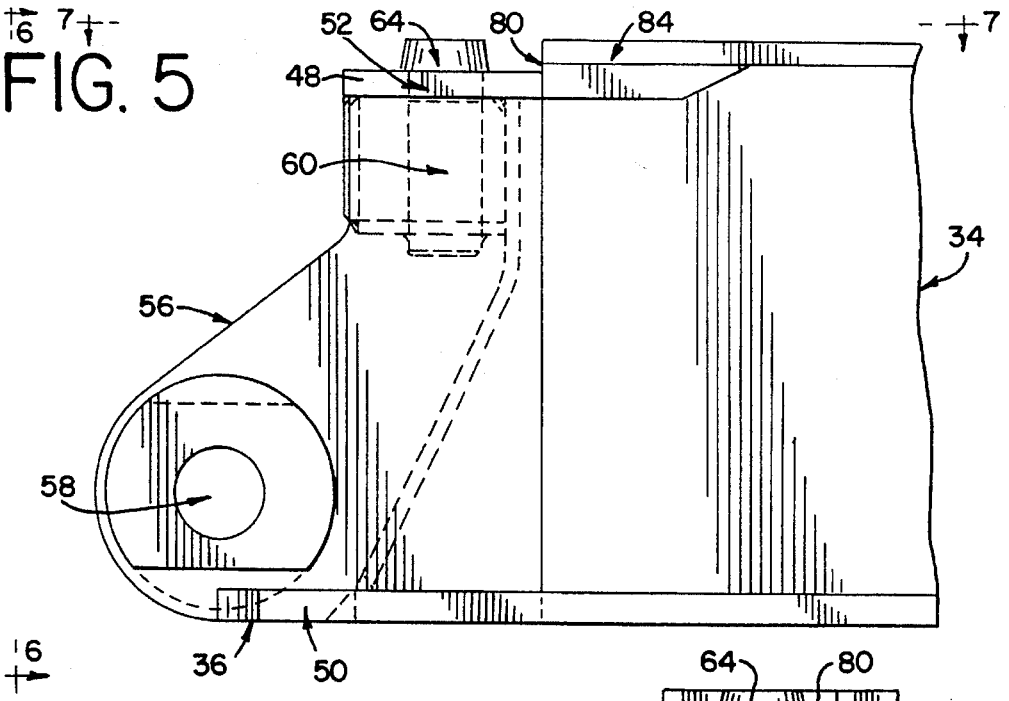
FIG. 5 is an elevational view taken along line 5—5 in FIG. 3.
Figure 6:
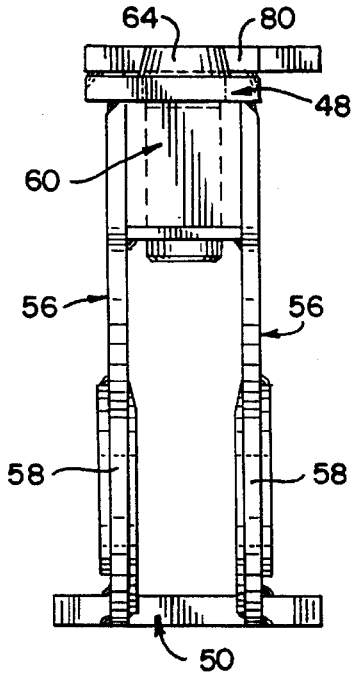
FIG. 6 is an end view taken along line 6—6 of FIG. 5.
Figure 7:
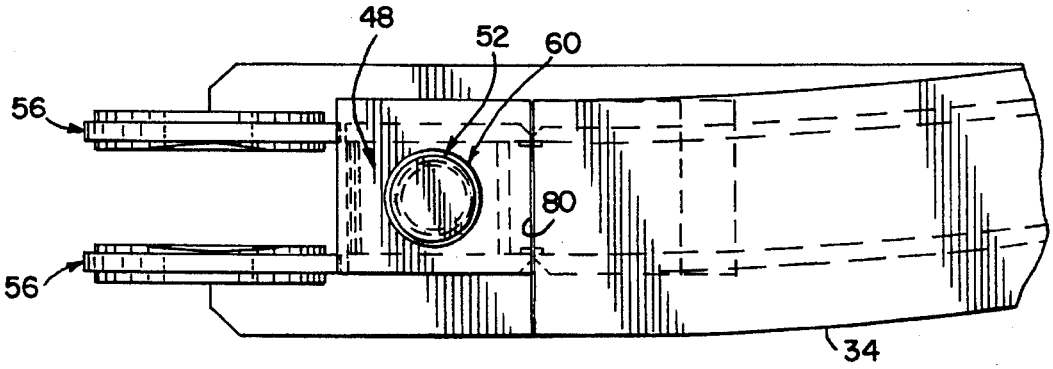
FIG. 7 is a plan view taken along line 7—7 of FIG. 5.

As shown in FIG. 5, 6 and 7, an end of a first ring segment 34 includes a connector 36 having an upper horizontal plate 48 having a hole 52 therein, two vertical plates 56 secured between the upper horizontal plate 48 and a lower plate 50, each vertical plate 56 having a hole 58 therein, and a pin 60 disposed within the hole 52 in the horizontal plate 48 and having a tapered head 64 extending therefrom. As shown in FIG. 5, the taper is such that the head 64 widens as it gets closer to the body of the pin 60. The vertical plates 56 are spaced apart from one another and the holes 58 therein are aligned such that a pin 104 (FIG. 12) may be inserted therethrough. The upper horizontal plate 48 also includes a vertical surface 80 formed by the top plate 84.

Figure 12:
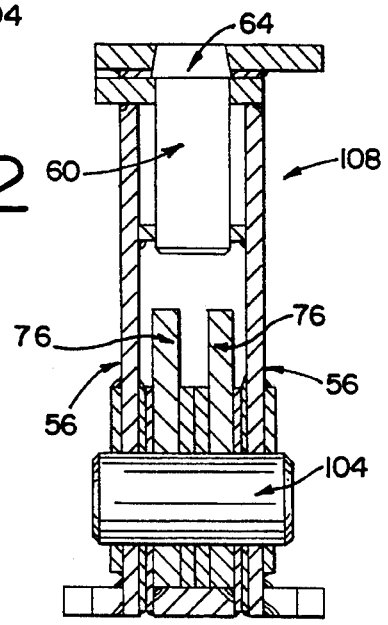
FIG. 12 is an end view taken along line 12—12 of FIG. 11.

FIGS. 8, 9 and 10 illustrate a connector 44 of a second ring segment 40. The connector 44 comprises an upper horizontal plate 68 ending at vertical edge 100 and having a tapered hole 72 therein. The tapered hole 72 is sized to receive the tapered head 64 of the pin 60 of the first ring segment 34, as will be fully described below. The connector 44 further comprises two vertical plates 76 secured between the horizontal plate 68 and a lower plate 88, each vertical plate 76 having a hole 92 therein. The vertical plates 76 are spaced slightly apart and are sized to fit between the vertical plates 56 of the first ting segment 34, as shown in FIG. 12. The vertical plates 76 preferably include support flanges 96 positioned around the hole 92 of the vertical plates 76 and on either side thereof. The support flanges provide a larger surface contact area for the pin 104 than the two vertical plates 76. The larger surface contact area permits the pin to carry larger imposed loads. The support flanges 96 may be secured to the vertical plates 76 by any suitable means, including welding.

Figure 11:
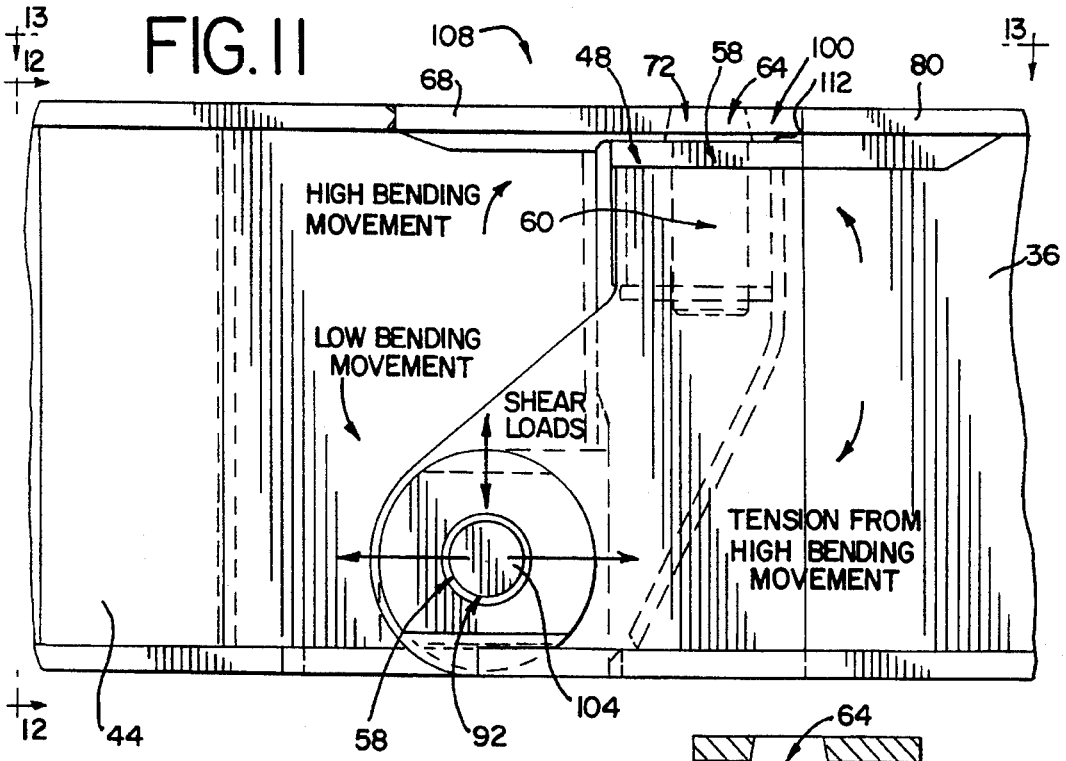
FIG. 11 is an elevational view of the connected ends of the ring segments of FIGS. 2 and 3.
Figure 13:
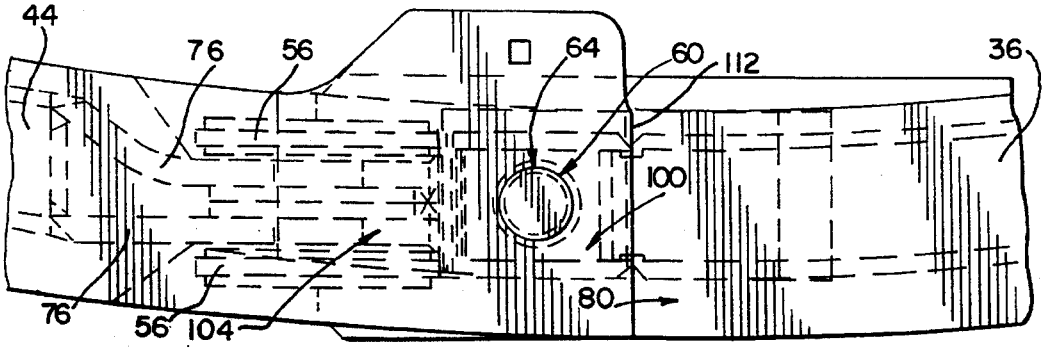
FIG. 13 is a plan view taken along line 13—13 of FIG. 11.

FIGS. 11, 12 and 13 show various views of a completed ting segment connection 108 between the first ring segment connector 36 shown in FIGS. 5, 6 and 7 and the second ring segment connector 44 shown in FIGS. 8, 9 and 10. As can be seen from the drawings, when a ring segment having the second ring segment connector 44 is lowered onto a ring segment having a first ring segment connector 36, the tapered hole 72 of the horizontal plate 68 receives the tapered head 64 of the pin 60 residing in the hole 58 of the horizontal plate 48. At the same time, the vertical plates 76 of the second ring segment connector 44 are received between the vertical plates 56 of the first ring segment connector 36. The capture of the tapered head 64 in the tapered hole 72 of the horizontal plate 68 aligns the holes 58, 92 of the vertical plates 56, 76 of the connectors 36, 44. At this time, a pin 104 is inserted through the holes 58, 92 to complete the connection 108.

The design of the connectors 36, 44 permits the ring segment connection 108 to effectively carry many forces caused by the weight of the crane 10 and its load. As shown in FIG. 11, shear loads and two bending moments—a high bending moment and a low bending moment—are carded by the connection 108. The high bending moment is resolved as a compressive force on the bearing surface 112 created at the interface of the vertical edge 100 and the vertical surface 80, and as a tensile load carried as a shear force through the lower pin 104. The low bending moment is resolved as a shear load carried by the tapered pin 60 and the mating hole 72. Furthermore, any vertical shear loads are also carried through the lower pin 104.

The load carrying advantages of the above-described connection 108 over the prior an connections can be readily discerned. As previously discussed, the prior an ring segments were typically bolted together along either a horizontal or a vertical plane to form a ring support. Because of this design, the bolts had to carry all of the forces—compressive, shear, tensile, etc.—created by the crane and its load. In the present invention, the design of the connectors 36, 44 causes the high bending moment to be resolved as a compressive force on the bearing surface 112. Since the bearing surface is created at the interface of two plates, it is a much better force-carrying member than a bolt. Furthermore, shear loads are carried by a horizontal pin 104, which is a better load-carrying member than the threads of a bolt.

The manner of assembling the ring support structure 14 will now be discussed. In the preferred embodiment of the present invention, as shown in FIG. 2, the ring segments 22 are positioned adjacent one another such that they generally form a ring. The first and second ring segments 34, 40 are alternately positioned such that no two of the same type of ring segment are adjacently positioned. The second ring segments 40 are lifted and positioned such that their connectors 44 are aligned with the connectors 36 of the first ring segments 34. The second ring segments 40 are then lowered until the horizontal plates 48, 68 and the vertical plates 56, 76 of the connectors 36, 44 matingly engage one another. At this point the pin 104 is inserted to complete each connection 108.

While only one embodiment of the present invention has been described above, it must be understood that the ring segment connectors 36, 44 can be configured in a number of ways as appropriate for the application. For example, the connectors 36, 44 may have more than or less than two vertical plates. Also, the horizontal and vertical plates of the connectors may be bolted together instead of being pinned together. Furthermore, the ends of each ring segment 22 do not necessarily have to include identical connectors 36, 44. Additionally, the ring support 14 may be comprised of less than or greater than four ring segments 22. Thus, the embodiment described above is to be considered in all respects only as illustrative and not restrictive. The scope of the invention is indicated by the following claims rather than by the foregoing description. All changes which come within the meaning and range of equivalency of the claims are to be embraced within their scope.

What is claimed is:

1. A ring for supporting a lift crane and its load comprising at least two ring segments each having two ends, the ends of a first ring segment each comprising a horizontal plate and at least one vertical plate, and the ends of a second ring segment each comprising a horizontal plate and at least one vertical plate, the respective horizontal plate and the at least one vertical plate of adjacent ends of the ring segments being disconnectably secured to one another at a ring segment connection to form the ring wherein a) a horizontal pin connects the vertical plates together, b) a vertical pin connects the horizontal plates together, c) the horizontal plates each having a compressive load bearing surface which abut each other, d) the horizontal pin is located below the horizontal plates, e) vertical force imposed on the ring by the load is transferred through the connection by the horizontal pin in shear, and f) a high bending moment created in the connection by the load is resolved as a compressive force on the bearing surface between the horizontal plates and as a tensile load carried as a shear force by the horizontal pin.

2. The ring of claim 1 wherein each of the horizontal and vertical plates of the at least two ring segments define at least one hole therein, the horizontal and vertical plates of adjacent ends of the ring segments being disconnectably secured by means of said pins disposed through the holes.

3. The ring of claim 2 wherein the vertical pin is secured within the hole defined in each horizontal plate of the two ends of the first ring segment, and wherein the horizontal plate of each end of the second ring segment matingly engage the vertical pins to interconnect the ring segments.

4. The ring of claim 3 wherein each vertical pin has a tapered head such that the head widens as it gets closer to the body of the pin and the holes in the horizontal plates of the second ring segment are tapered to receive the tapered head.

5. The ring of claim 2 wherein each of the at least two vertical plates comprises a support flange positioned around the hole.

6. The ring of claim 1 wherein the at least one vertical plate of the two ends of each ring segment comprises two parallel plates.

7. The ring of claim 6 wherein the two parallel plates of the first ring segment are disposed between the two parallel plates of adjacent ends of the second ring segment when the ring segments are connected to form the ring.

8. The ring of claim 1 wherein the configuration of the horizontal and vertical plates of the two ends of the first ring segment are identical, and wherein the configuration of the horizontal and vertical plates of the two ends of the second ring segment are identical.

9. The ring of claim 1 wherein the vertical plates of the at least two ring segments define at least one hole therein, the vertical plates of adjacent ends of the ring segments being disconnectably secured by means of said pins disposed through the holes.

10. The ring of claim 1 wherein the at least two ring segments comprises four ring segments.

11. The ring of claim 10 wherein the ends of a first two of the ring segments are identical, and wherein the ends of a second two ring segments are configured to matingly engage the ends of the first two ring segments.

12. The ring of claim 1 wherein the at least two ring segments have identical arc lengths.

13. The ring of claim 1 wherein a low bending moment created in the connection is resolved as a shear load carried by the vertical pin.

14. A ring for supporting a lift crane and its load comprising:

a) at least one first ring segment having two ends, each end comprising:

i) a first horizontal plate having a hole therein and a compressive load bearing surface, and ii) at least one first vertical plate attached to the first horizontal plate and having a hole therein;

b) at least one second ring segment having two ends, each end comprising:

i) a second horizontal plate having a hole therein and a compressive load bearing surface and positioned to overlie the first horizontal plate of an adjacent end of the at least one first ring segment such that the compressive load bearing surface of the second horizontal plate abuts the compressive load bearing surface of the first horizontal plate, and ii) at least one second vertical plate attached to the second horizontal plate and having a hole therein, the at least one second vertical plate positioned such that the holes in the first and second vertical plates are aligned;

c) a vertically-oriented pin that is perpendicularly disposed to a plane formed by the ring connecting the horizontal plates of adjacent ends of the at least one first and second ring segments; and d) a horizontally-oriented pin that is disposed below the horizontal plates and along a radius of the ring connecting the vertical plates of adjacent ends of the at least one first and second ring segments to form the ring, thus forming a ring segment connection wherein e) vertical force imposed on the ring by the load is transferred through the connection by the horizontal pin in shear, and f) a high bending moment created in the connection by the load is resolved as a compressive force on the bearing surface between the horizontal plates and as a tensile load carried as a shear force by the horizontal pin.

15. The ring of claim 14 wherein the pin used for connecting the horizontal plates of the at least one first and second ring segments is secured in the hole of the first horizontal plate, and wherein the pin fits within the hole of the second horizontal plate when the at least one first and second ring segments are connected to form the ring.

16. The ring of claim 15 wherein the pin used for connecting the horizontal plates has a tapered head such that the head widens as it gets closer to the body of the pin, and wherein the hole of the second horizontal plate is configured to receive the tapered head.

17. The ring of claim 14 wherein the at least one first ring segment comprises two first ring segments, and wherein the at least one second ring segment comprises two second ring segments, the first and second ring segments being connected to form the ring such that each first ring segment is connected between two second ring segments and each second ring segment is connected between two first ring segments.

18. The ring of claim 17 wherein the first ring segments and the second ring segments have identical arc lengths.

19. The ring of claim 14, further comprising power means for inserting the pins to connect the ring segments to form the ring.

20. The ring of claim 14 wherein the first horizontal plate comprises a top plate, and wherein the hole of the first horizontal plate is positioned between the end of the plate and a vertical surface formed on the end of the top plate, the vertical surface forming the compressive load bearing surface of the first horizontal plate, and wherein a vertical edge forming the compressing load bearing surface of the second horizontal plate engages the vertical surface when the second horizontal plate is positioned to overlap the first horizontal plate.

21. The ring of claim 14 wherein a low bending moment created in the connection is resolved as a shear load carried by the vertical pin.

* * * * *

UNITED STATES PATENT AND TRADEMARK OFFICE

CERTIFICATE OF CORRECTION

PATENT NO. : 5,522,515
DATED : June 4, 1996
INVENTOR(S) : David J. Pech et al.

It is certified that error appears in the above-indentified patent and that said Letters Patent is hereby corrected as shown below:

In claim 3, line 5, delete "engage" and substitute --engages--.

In claim 10, line 2, delete "comprises" and substitute --comprise--.

Signed and Sealed this

First Day of July, 1997

Bruce Lehman

*Attest:*

BRUCE LEHMAN

*Attesting Officer*

*Commissioner of Patents and Trademarks*